US005267866A

United States Patent [19]

Swift et al.

[11] Patent Number: 5,267,866

[45] Date of Patent: Dec. 7, 1993

[54] FLEXIBLE ELECTRICAL INTERCONNECT

[75] Inventors: Joseph A. Swift, Ontario; Joan R. Ewing, Fairport, both of N.Y.; Victor Zaderej, Hamden, Conn.

[73] Assignee: Xerox Corporation, Stamford, Conn.

[21] Appl. No.: 808,697

[22] Filed: Dec. 17, 1991

[51] Int. Cl.[5] ..... H01R 23/68; H01R 39/00

[52] U.S. Cl. ..... 439/31; 439/65

[58] Field of Search ..... 439/31, 165, 287, 288, 439/295, 65, 290, 291

[56] References Cited

U.S. PATENT DOCUMENTS

| | | | |
|---|---|---|---|
| 3,838,234 | 9/1974 | Peterson | 29/453 |
| 4,140,357 | 2/1979 | Wolz et al. | 174/86 |
| 4,175,315 | 11/1979 | Hayes, Sr. et al. | 29/453 |
| 4,841,099 | 6/1989 | Epstein et al. | 174/258 |
| 4,922,064 | 5/1990 | Price et al. | 200/61.7 |
| 4,931,021 | 6/1990 | Mohan | 439/285 |
| 4,970,553 | 11/1990 | Orlowski et al. | 355/200 |
| 5,110,298 | 5/1992 | Dorinski et al. | 439/65 |

FOREIGN PATENT DOCUMENTS

| | | | |
|---|---|---|---|
| 0159593 | 10/1985 | European Pat. Off. . | |
| 2591054 | 6/1987 | France | 439/65 |
| 206132 | 8/1979 | German Democratic Rep. | 439/65 |
| 208891 | 8/1989 | Japan | 439/65 |

*Primary Examiner*—Gary F. Paumen
*Attorney, Agent, or Firm*—Oliff & Berridge

[57] ABSTRACT

An interconnect for electrically connecting two members having conductive wiring on respective surfaces thereof includes first and second hinge parts of electrically insulating material which are mutually pivotable when placed in a mating position. The hinge parts have mutually contacting electrically conducting portions when the first and second hinge parts are in their mating position, and the electrically conducting portions are in electrical contact with the conductive wiring on the respective surfaces of the two members. The conductive wiring is arranged on the two members such that when the members are secured, for instance, to assemblies to be interconnected, the conductive wiring aligns with and contacts the desired wires or traces on the interconnected assemblies. In one embodiment, the hinge assemblies are manufactured from a substrate of an electrically insulating polymer matrix which is doped with an electrically insulating fibrous filler capable of heat conversion to an electrically conductive fibrous filler to form a conductive trace. The conductive trace of one assembly is electrically connected to the conductive trace of the other assembly by mating portions of said hinge assemblies, each mating portion including a conductive layer on a surface thereof in direct electrical communication with a corresponding conductive layer on opposing mating portions of said other hinge assembly to provide electrical connection between the conductive traces of said hinge assemblies through a pivotal movement of said one hinge assembly relative to said other hinge assembly. The hinge assemblies may be pivotally interconnected by a hinge pin or by a snap fit relationship between male protrusions on one assembly and female sockets on the other assembly.

17 Claims, 3 Drawing Sheets

FLEXIBLE ELECTRICAL INTERCONNECT

FIELD OF THE INVENTION

This invention relates to improvements in electrical interconnects, and more particularly to improvements in flexible electrical interconnects, and still more particularly to improvements in electrical interconnects fabricated in hinge type structures.

BACKGROUND OF THE INVENTION

As will become apparent, the invention has wide interconnect applications, and will, for example, find important interconnect uses such as those in the three dimension, printed wiring board (3D PWB) industry. One application that is illustrative, however, for which a preferred embodiment of the invention is particularly suitable, is in serving interconnection functions in electrostatographic reproducing machines. Recently, in order to minimize maintenance costs by permitting the operator to replace worn out or exhausted processing units in electrostatographic apparatus, emphasis been placed on incorporating one or more processing units of the apparatus in disposable or removable cartridges or units. In this way the operator can readily remove each cartridge when its operational life has been exhausted and insert a new cartridge. In addition, it also provides the advantages of providing for easier service and diagnostics access to the internal subsystems of a reproducing machine and enabling less expensive functional features.

In these applications, it is necessary to distribute power and/or logic signals between the various units, subsystems, and/or cartridges of the machine. Traditionally, this has been accomplished utilizing conventional wires and wiring harnesses in each machine to distribute power and logic signals between, for example, the main frame of the machine and a removable processing unit or a subsystem unit. For instance, conventional plug and socket arrangements have been used which can be either manually connected or joined automatically on insertion of the unit into the main frame. Such automatic joining requires precision positioning and alignment of the unit on insertion with very low tolerance for error. Typically locating members such as pins or rails are used to insure proper positioning, all of which adds to the manufacturing cost of the machine. In addition, conventional wires and wiring harnesses are flexible and therefore, do not lend themselves to automated assembly such as with the use of robots further leading to increased manufacturing costs.

Presently, many types of interconnects, particularly high voltage connectors, are routinely manufactured by insert molding a preformed metal pin or socket into an insulating plastic housing. Often a suitable wire is simultaneously insert molded within the same connector housing to produce a complete connector assembly. There are, however, at least three to five separate steps to manufacture conventional high voltage connectors.

Moreover, in many typical copies systems, it is desired to provide a flexible interconnection between wires of different assemblies, circuit boards, or other members in the system. Such flexible interconnects have been accomplished in the past by such techniques as flexible ribbon wires with plugs that attach to mating plugs on the members to be interconnected. Such ribbon wiring arrangements, however, do not lend physical support between the interconnected members, and also often involve intensive labor fabrication requirements. Furthermore, such harnesses may have to be handled or moved several times to make all connections required. This is a highly labor intensive task, frequently requiring routing of the several harnesses through channels and around components manually with the final connections being also accomplished manually, thereby resulting in potential human error in the assembly, which might be reduced with the use of automated and in particular robotic assembly. In addition to the relatively high labor costs associated with electrical harness construction and installation, it is well to note that such wiring harnesses are less than totally reliable in producing their intended function. Furthermore, and with increasing sophistication of the capabilities of such products, a plurality of wiring harnesses may be required in any individual machine which can require a large volume of space thereby increasing the overall size of the machine. Accordingly, there is a desire to provide an alternative to the conventional wiring and wiring harnesses that overcomes these difficulties.

While certain other types of electrical contacts have been proposed, they suffer certain deficiencies. For example, the use of two conventional metal plate contacts such as two spring biased metal tabs, for instance, one on a main frame and one on a removable unit, in addition to requiring the precision positioning and alignment discussed above can be rendered unreliable after only a short period of use in a hostile machine environment, as might be encountered in a reprographic copier, by having the contacting surfaces contaminated by dirt, toner, or other debris. Furthermore, such metal contacts tend to oxidize forming an insulating layer on the contact surface thereby further degrading the reliability and performance of the contact.

To address these and other problems, and with recent emphasis toward the goal of replacing conventional wire harnesses and connectors in copier products to achieve a so-called "wireless copier", what is needed is an electrical interconnect that is sufficiently flexible to enable molded plastic circuits to be assembled, at will, around corners, if desired, and which can provide mechanical support between the interconnected assemblies, as well.

PRIOR PATENTS

U.S. Pat. No. 3,838,234 to Peterson discloses a metallic hinge having leaves with aligned knuckles through which a hinge pin extends. The pin is anchored to the knuckle of one of the leaves are carries a dielectric contact spindle on which slip rings are mounted. The knuckle of the other leaf has a dielectric receptacle provided with contact blades which engage the slip rings. The engaged contact blades and slip rings complete electrical circuits through the hinge, but do not interfere with disassembly of the hinge.

U.S. Pat. No. 4,140,357 to Wolz et al. discloses a metallic hinge which facilitates reception and passage of one or more electrical conductors in the form of insulated electrical wires in a manner in which the wires are continuous and unbroken through the hinge and are maintained in a completely concealed relation and effectively protected from attack when the hinge leaves and barrels are pried apart.

U.S. Pat. No. 4,175,315 to Hayes, Sr. et al. discloses an all plastic hinge comprising plastic hinge halves each of which includes a generally planar hinge leaf and one or more knuckles integral therewith and providing a passage for receiving a hinge retaining pin and defining an axis of pivotal movement of the hinge.

U.S. Pat. No. 4,922,064 to Price et al. discloses a metallic hinge that contains a door position indicator within its knuckles for indicating when the door is open or ajar. The indicator comprises a proximity switch which is adjustably mounted on the frame leaf attached to the doorjamb.

SUMMARY OF THE INVENTION

In light of the above, it is, therefore, an object of the invention to provide an improved flexible electrical interconnect.

It is another object of the invention to provide an interconnect of the type described that is sufficiently flexible to enable molded plastic circuits to be assembled around corners.

It is still another object of the invention to provide an interconnect of the type described which enables contact to be established between conductive paths that have been electroplated or otherwise formed on separate parts of frames, boards, or the like.

It is yet another object of the invention to provide an interconnect of the type described which can be used to advantage in larger parts or assemblies that have parts which move relative to each other, while maintaining electrical continuity between circuit elements on each.

It is still yet another object of the invention to provide an interconnect of the type described which is reusable and can be used to advantage in speeding up of prototype construction and for advantage in diagnosing and servicing machines.

These and other objects, features, and advantages of the invention will be apparent to those skilled in the art from the following detailed description, when read in conjunction with the accompanying drawings and appended claims.

In one broad aspect of the invention, an interconnect for electrically connecting two members having conductive traces on respective surfaces thereof is presented. The interconnect includes first and second hinge parts of electrically insulating material, which are mutually pivotable when placed in a mating position. There are protruding features on each hinge part that have electrically conducting portions that are mutually contacting when the first and second hinge parts are in their mating position, and the electrically conducting portions are arranged to be in electrical contact with the conductive traces on the respective surfaces of the two members.

In another broad aspect of the invention, a flexible electrical interconnect for electrically connecting respective conductive leads of two members and physically connecting the two members pivotally about an axis is presented. The interconnect includes a pair of hinge parts, each attachable to a corresponding one of the members, and each manufactured from a substrate of an electrically insulating polymer matrix. Portions of the substrate can be image or laser patterned and subsequently metal plated to form a conductive trace. The conductive trace of one part is electrically connected to the conductive trace of the other part by mating portions of the hinge parts, each mating portion including a conductive layer on a surface thereof in direct electrical communication with a corresponding conductive layer on opposing mating portions of the other hinge part to provide electrical connection between the conductive traces of the hinge parts through a pivotal movement of the one hinge part relative to the other hinge part.

BRIEF DESCRIPTION OF THE DRAWING

A preferred embodiment of the invention is illustrated in the accompanying drawings, in which.

In the various figures of the drawing, like reference numerals are used to denote like or similar parts. Moreover, in the drawings various sizes and dimensions of the parts may have been exaggerated or distorted for clarity of illustration or ease of description.

DETAILED DESCRIPTION OF THE PREFERRED EMBODIMENTS

The electrical interconnect, in accordance with a preferred embodiment of the invention, is of design similar to that of a hinge and pin of the type often found in a door hinge, or the like. Such hinges are generally made from stamped or formed metal (usually brass or steel) and function as small mechanical features on larger assemblies.

Figure 1:
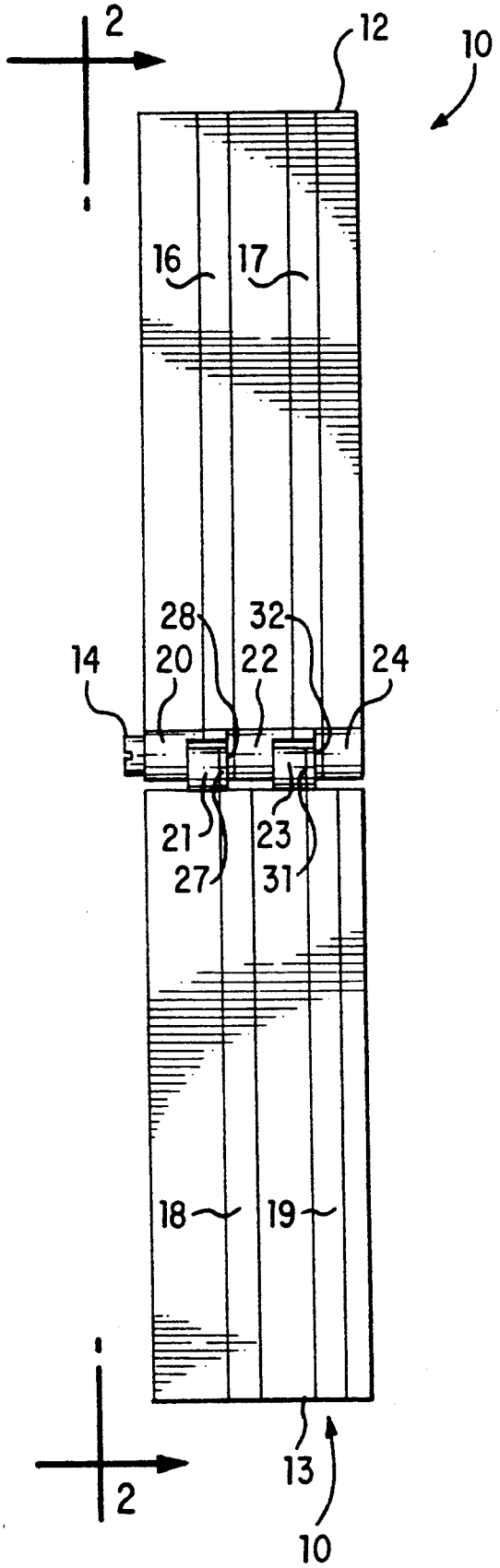
FIG. 1 is a top view of a hinge-type electrical interconnect, in accordance with a first preferred embodiment of the invention, shown with the hinge in an open position.
Figure 2:
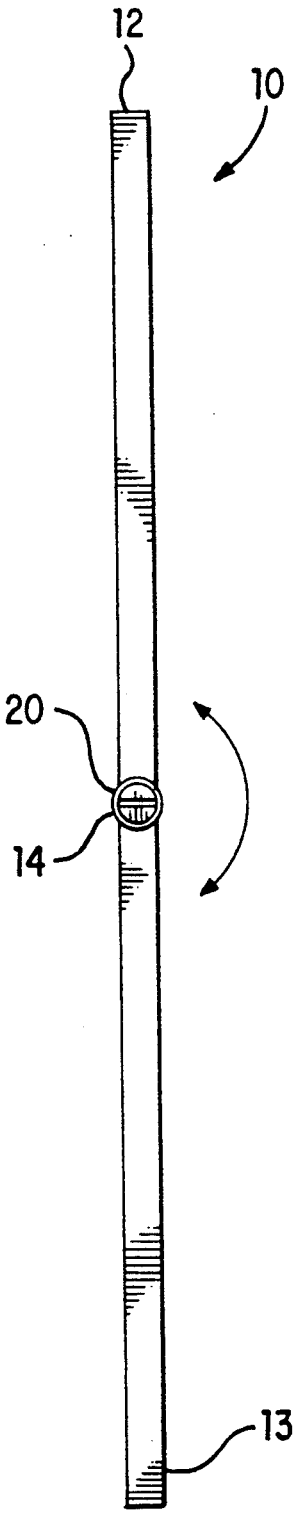
FIG. 2 is a side view of the hinge-type electrical interconnect, of FIG. 1.
Figure 3:
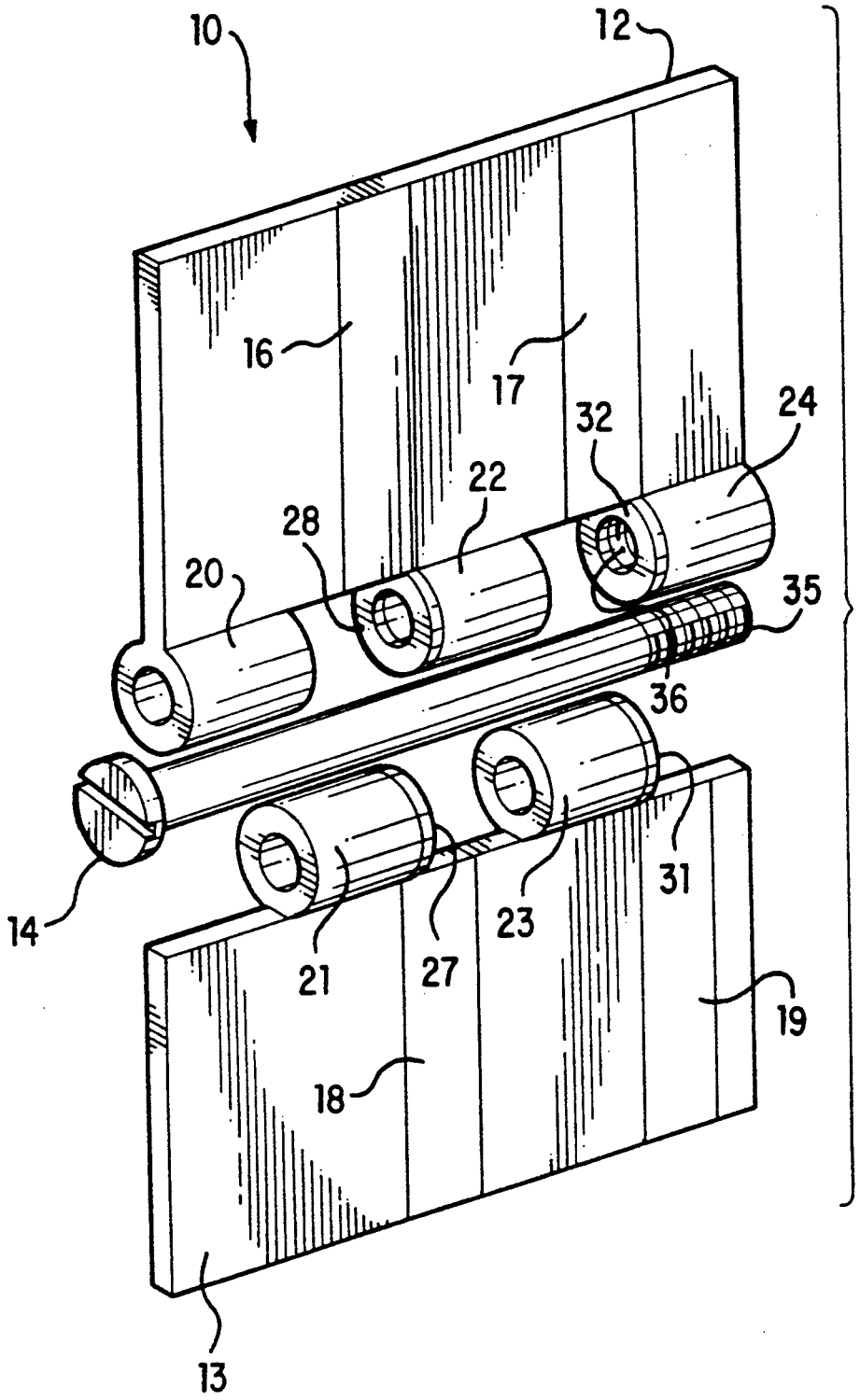
FIG. 3 is an isometric exploded view of a hinge-type electrical interconnect, in accordance with the preferred embodiment of the invention shown in FIG. 1.

Thus, with reference to the drawings of FIGS. 1–3, the interconnect assembly 10, in accordance with a preferred embodiment of the invention, comprises three parts: two interlocking, electrically insulating hinge leaves 12 and 13, and a joining pin 14. The two interlocking hinge leaves 12 and 13 are substrates formed of electrically insulating material, such as molded plastic, for example a polymer matrix that is filled with electrically insulating fibers that are capable of heat conversion to electrically conducting fibers, or a polymeric matrix containing or coated with a metallic or organometallic salt which is thermally or otherwise convertible to a suitable metallic pattern for subsequent electroless or electrolytic metal plating, or the like, and have one or more electrically conducting traces 16, 17, 18, and 19 formed along one or more of their surfaces. For example, a plurality of traces can be formed to carry power, ground return, logic, and timing, and other signals that may be required in the particular application in which the hinge interconnect is employed. Also, it will be appreciated that although conductive traces can be formed on either top and/or bottom surfaces of the hinge leaves, preferably the traces are formed on a particular surface of the hinge leaf such that when the hinge leaves are attached to, or formed as part of the assemblies or members (not shown) to which the electrical interconnection are to be made, the traces will directly contact the conductors or wires (not shown) of the members to which the connections are to be made.

The leaf members 12 and 13 each have a mating portion including knuckle elements 20–24 formed, such as by molding, as an integral part of the substrate portions, on one or more of their ends. A gap exists between each pair of knuckles, e.g., 20 and 22, 22 and 24 and 21 and 23. The knuckle elements 20–24 illustrated are of hollow barrel shape, with one edge of selected knuckles suitably metal plated to form circular electrical contacts. Thus, for example, one end of the element 21 is metal plated to provide a contact ring 27, and one end of the knuckle element 22 is metal plated to provide a contact ring 28, whereby when the knuckles are placed in their pivoting mating relationship, the contact rings 27 and 28 will be in physical and electrical connection with each other. Similar contact rings can be provided on other knuckle elements, if desired, such as contact rings 31 and 32 on knuckle elements 23 and 24, respectively.

The circular contacts are electrically connected to respective metal traces on the surface of the hinge sections. For instance, the traces 16, 17, 18, and 19 are connected to the respective circular contact rings (or layers) 28, 32, 27, and 31. In some embodiments, a large number of mating hinge features may be provided to join longer straight sections to interconnect a large number of signals, power voltages, and the like, and, as mentioned, hinge features may be provided on other edges of the substrate to allow for stringing two or more of the sections together in applications such as in circuit networks.

The hinge pin element 14 also is of an electrically insulating material, such as plastic, or the like, or it can be made from an insulator coated metal and serves as the hinge pivot point to enable angular movement of the hinge sections and their respective contacts. The pin element 14 can be threaded to present threads 35 at one end, as shown, to be screw tightened into threads 36 of a threaded receiver portion within one of the knuckle elements 24 of one of the hinge sections to secure the two hinge leaves 12 and 13 together. Thus secured, the pin element also provides for a controlled force acting upon the circular contacts 27, 28, 31 and 32 to assure a reliable interconnect function.

Figure 4B:
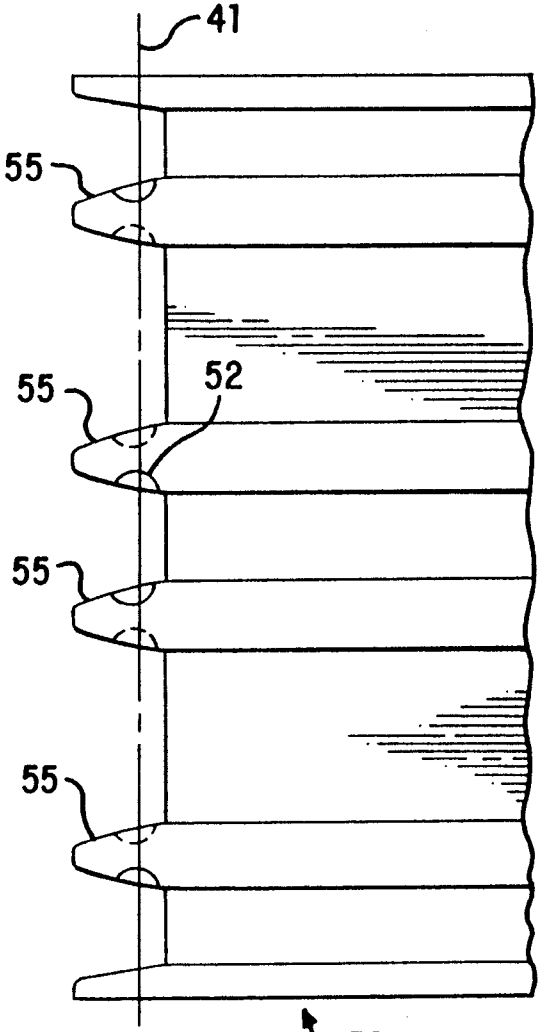
FIG. 4B is a plan view of a male part of the embodiment of the invention used with the female part of FIG. 4A.
Figure 4A:
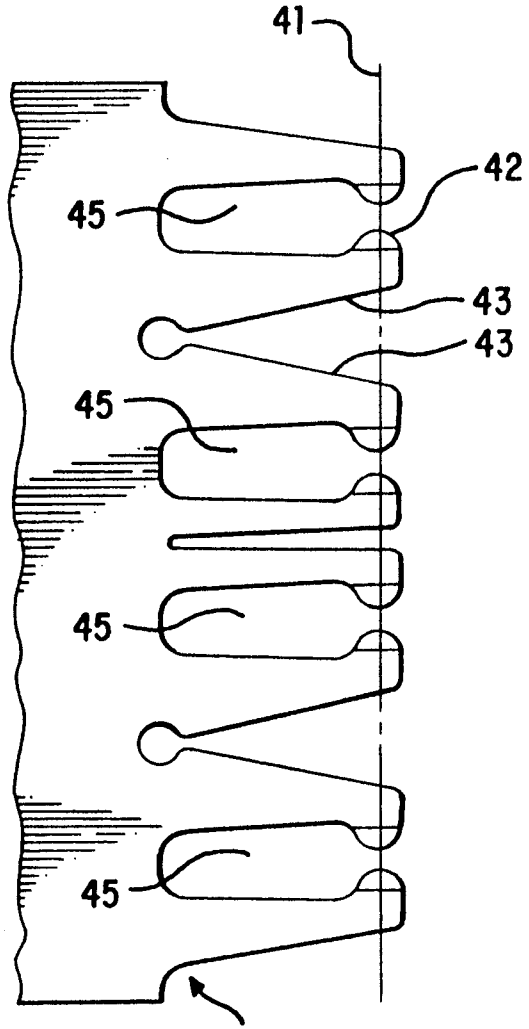
FIG. 4A is a plan view of a female part of another embodiment of the invention.

In another embodiment, the hinge is formed by the snap fit mating of two parts shown in FIGS. 4A and 4B. FIG. 4A illustrates a female mating portion 40 having sockets 45 defined between cantilever beam elements 43. A tip of each cantilever beam element 43 adjacent the socket 45 includes a contact portion element (or layer) 42, with each contact portion element being aligned along a pivot line 41. FIG. 4B illustrates the male mating portion 50 having male protrusion element 55 spaced for reception within corresponding sockets 45 of the female mating portion 40. Each male protrusion element 55 includes a contact portion element (or layer) 52 on each side of the protrusion element 55 received within the socket 45. The contact portion elements 52 are aligned along the pivot line 41. In the preferred embodiment of FIGS. 4A and 4B, the contact portion elements 42 on the female mating portion 40 are projections and the contact portion elements 52 on the male half 50 are correspondingly shaped depressions. Upon insertion of the male protrusion elements 55 into the sockets 45, the cantilever beam elements 43 deform to slightly separate to permit entry of the male protrusion elements 55. The cantilever beam elements 43 then resiliently return to their rest position to engage the male protrusion elements in a snap fit relationship. The contact portion element projections 42 are received within the contact portion element depressions 52, all of which are aligned along the pivot line 41.

It has been shown that the properties of certain glass filled plastics such as 2312 Ultem from General Electric are such that when molded features such as the cantilever beam snap fit are properly designed, the normal forces in the mated contact areas of portions 42 and 52 are within the range bounded on the low side by the electrical requirement of 150–300 gram force per contact and on the high side by the desired insertion force to be applied when mating the hinge connector female mating portion 40 with male mating portion 50 at pivot line 41, of about 5–15 pounds. This contact force is achieved by deformation from the rest position of the cantilever beam elements 43. In the previous embodiment, the contact force is applied and maintained by the hinge pin element, and some deformation occurs to the knuckle elements as a result of the compression applied by means of the screw threads during rotation of the pin element. Deformation in both cases assures contact pressure at all contact points. (In this second embodiment, fabrication and assembly are simplified by elimination of the hinge pin element but no adjustment to the contact force is possible after the part is made, in the event of stress relaxation of the plastic due to elevated temperatures for example.)

The hinge interconnect, in accordance with one embodiment of the invention, may be formed through known techniques for forming electrical components having an electrically conductive path on a thermoplastic substrate formed by the electroless deposition of conductive metals on a path or pattern of nucleation sites of catalyst for the electroless deposition of conductive metals anchored in, or upon the thermoplastic.

More specifically, the surface of a thermoplastic substrate which will constitute the hinge leafs, and possibly the knuckle assemblies, is modified to promote adhesion of the metal to the substrate. To this end, first a catalyst precursor for the electroless deposition of conductive metals is applied to the surface of the thermoplastic substrate. Then, the substrate is selectively heated, or otherwise energized to cause the decomposition of the catalyst precursor in the areas in which the conductive traces are to be formed. At the same time, the heating causes softening of the thermoplastic surface to enable the catalyst to penetrate the surface of the softened plastic and be anchored in place onto the thermoplastic. The heating can be done by a laser beam, preferably a focused carbon dioxide laser, directed to the desired conductive paths. Finally, the catalyst precursor is preferably removed from the unheated areas of the substrate, and a conductive metal is deposited by known electroless deposition techniques to form the conductive traces on the surface regions having the nucleation sites which have been created by the heating and catalyst precursor doping steps described.

Another technique by which the hinge interconnect, in accordance with another embodiment of the invention, may be formed is through known techniques for forming electrically conductive paths in a polymer matrix which is filled with electrically insulating fibers that are capable of heat conversion to electrically conducting fibers. By such technique, by selectively heating the filled polymer matrix the electrically conductive paths can be formed in situ. This technique is disclosed in U.S. Pat. Nos. 4,841,099 and 4,970,553 to Epstein et al and Orlowski et al, respectively, the disclosures of which are herein incorporated by reference.

More particularly, the electrically insulating polymer matrix which will form the hinge leaves and knuckle assemblies are loaded or doped with a suitable polymeric fibrous material capable of heat conversion to conductive fibrous carbon within the polymer matrix. Examples of suitable fibrous filler are cellulose (rayon), petroleum pitch based carbon fibers which are heat convertible carbonaceous fibers, and thermally stabilized, polyacrylonitrile fibers. The fiber filed polymer matrix doped with such fibers may be formed into the hinge assemblies by conventional or injection molding or other plastic casting techniques.

The selective heating required to convert the electrically insulating fibrous filler to an electrically conductive filler in the desired areas can be carried out in any suitable manner. Again, preferably, a laser, such as a carbon dioxide laser, may be used to direct the laser beam to the selected portions of the polymer matrix to be pyrolyzed by melting the polymer and heat converting the electrically insulating fibers to electrically conductive fibers to form the conductive path.

The processes described above for making metal patterns on plastics are characterized as fully additive since etching or removal of metal is not an intrinsic requirement of the patterning process. Another well known process is called two shot molding whereby a resin able to be catalyzed for electroless plating forms one component of the molded part and another resin not sensitized forms the other component. The composite part can therefore be selectively plated in a pattern determined by the mold. The hinge interconnect may also be formed through other known techniques for accomplishing selective plating on plastics using resists. They are broadly characterized as semiadditive or subtractive according to whether the metal, usually copper, is initially plated everywhere in a very thin layer and then added in the desired pattern, or plated everywhere to the final desired thickness and then subtracted in the background areas. The term pattern is used to mean the surface areas desired to be conductive and background refers to the surface areas desired to be insulating. In both cases a resist is selectively applied, either mechanically by selective coating application or photochemically. In the semiadditive process, the part is returned to an electroless or electrolytic plating bath where the resist prevents further plating in the background areas, but the thin layer of copper exposed in the desired pattern is built up in thickness. Finally the resist is removed and the entire part subjected to a short etch treatment to remove the background copper as well as a small amount in the pattern areas. In the subtractive process, a uniform layer of copper in the final desired thickness has a selective application of an etch resist, the background copper is removed, and then the resist is removed leaving bare copper in the pattern areas.

Thus, in operation, the hinge leaves can be pivoted or rotated relative to each other, and due to the mutual wiping contact by adjoining contacts of mating portions of the leaves, the electrical continuity between the corresponding electrical traces on the hinge leaves will be maintained.

In use, each of the hinge leaves may be connected to a respective one of the members to be interconnected, with the traces on the hinge leaves aligning with and contacting affiliated electrical wires or traces on the member. For example, the hinge leaves of the interconnect can provide contact between conductive paths that have been electroplated on separate parts of frames, boards, or other copier parts, thereby enabling electrical contact for the wireless copier, mentioned above. The hinge leaves can be attached by appropriate means, such as adhesives, nuts and bolts, screws, snap fits, press fits, or other suitable fastener (not shown). Naturally, the hinge feature referenced can be molded as a integral and small feature as part of a larger plastic piece part such as a molded circuit board, copier cover member, subsystem chassis, or other suitable machine part.

In some applications, for example, in the provision of a pivoting display or the like, the hinge leaves can be integrally formed as a part of the display and base to be physically interconnected with respective wiring sets to be electrically interconnected. Thus, for example, the hinge knuckles can be formed directly on respective edges of the parts, or, in some applications on an edge of one part and a central surface part of another.

Once the hinge leaves are affixed to the members or assemblies to be interconnected, the hinge knuckles are then aligned in mating relationship, bringing the respective conductive portions of the mating into electrical contact, and the pin inserted within the knuckles to secure and enable mutual pivoting or rotating action of the leaves. Upon servicing the machine, parts containing the referenced hinge feature can be easily pivoted about the hinge feature thereby permitting easy access to assemblies that may reside behind an interpositioned assembly. In this case, the need for full disassembly and removal of the interpositioned element is avoided thereby saving service labor. Further, once the interpositioned assembly is rotated to allow easy access to a heretofore hidden or inaccessible subsystem, power and signal interconnections to that assembly are maintained thereby allowing the assembly to be fully energized in the accessible state. This feature facilitates diagnostics of the copier and further saves on service labor.

It will be appreciated that the hinge leaves can be made interchangeable, facilitating, for example, the rapid substitution of parts or modules with which the hinge leaves may be associated. Such construction can be of advantage in facilitating rapid repair of systems by substituting sub-components, or in facilitating prototype development of equipment systems. Thus, the hinge interconnect, in accordance with a preferred embodiment of the invention, supports a "building block" approach to circuit and system development, providing a "user friendly" atmosphere to the development engineer.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

What is claimed is:

1. A flexible electrical interconnect, comprising:

a pair of hinge assemblies, each assembly being pivotal about an axis relative to the other assembly, each assembly manufactured from a substrate containing at least one conductive trace, each assembly including a mating portion that electrically connects the conductive traces of said hinge assemblies, each mating portion including a conductive layer on a surface thereof in direct electrical communication with a corresponding conductive layer on the other mating portion to provide electrical connection between the conductive traces of said hinge assemblies through a pivotal movement of said one hinge assembly relative to said other hinge assembly;

each mating portion comprising a first element extending in a direction substantially perpendicular to the axis;

the hinge assemblies being secured together by at least one second element extending along the axis from the first element of one of the mating portions;

the at least one second element being received within the first element of the other of the mating portions.

2. The electrical interconnect of claim 1, wherein the substrate comprises an electrically insulating thermoplastic substrate having a catalyst precursor capable of heat conversion to form the conductive trace on which a conductive metal is deposited.

3. The electrical interconnect of claim 1, wherein the substrate is an electrically insulating polymer matrix doped with an electrically insulating fibrous fiber capable of heat conversion to an electrically conductive fibrous filler to form the conductive trace.

4. A flexible electrical interconnect for electrically connecting at least two members having a plurality of separated electrical paths comprising:

a plurality of opposing hinge assemblies, each hinge assembly being pivotal about an axis relative to the other hinge assembly, each hinge assembly cooperating with a corresponding one of said members and having a plurality of separated electrically conductive paths each of which is in direct electrical communication with a corresponding one of said plurality of said separated electrical paths of said one of said members, each hinge assembly including a mating portion on at least one side thereof the mating portion of each hinge assembly having a conductive layer on a surface thereon in direct electrical communication with at least one of said electrically conductive paths of said hinge assembly, said plurality of electrically conductive paths of one hinge assembly being in direct electrical communication with the corresponding electrically conductive paths of said opposing assembly upon mating of said mating portions of said hinge assemblies;

each mating portion comprising a first element extending in a direction substantially perpendicular to the axis;

the hinge assemblies being secured together by at least one second element extending along the axis from the first element of one of the mating portions;

the at least one second element being received within the first element of the other of the mating portions.

5. A flexible interconnect for pivotally connecting a pair of members and enabling connection of a plurality of mutually independent electrical conductors from one of said pair of members to a plurality of corresponding mutually independent conductors on the other of said pair of members, comprising:

a pivotal insulating pin; and a pair of hinge assemblies rotatably supported by said pin, each of said hinge assemblies including a plurality of conductive paths located substantially on a face of said assembly and including a plurality of hollow barrel portions, at least equal in number to said plurality of conductive paths, formed on one edge of said hinge assembly, each barrel portion having a length and being separated from an adjacent barrel portion by a gap equal to the length of said hinge assembly barrel portions of the opposite said hinge assembly, wherein at least some of said barrel portions have at least one end face which comprises a conductive layer thereon, said conductive layer being in direct electrical communication with at least one of said conductive paths of said hinge assemblies, said hinge assemblies being mateable by aligning said barrel portions of one of said pair of hinge assemblies with the gaps of the opposing hinge assembly and inserting said insulating pin through said hollow barrel portions, wherein upon mating of said hinges, the conductive layers of adjacent barrel portions are forced into electrical communication to complete a flexible electrical connection between said hinge assemblies.

6. An interconnect for electrically connecting two members having conductive surfaces, the interconnect comprising:

first and second hinge parts of electrically insulating material, said first and second hinge parts being mutually pivotable about an axis when placed in a mating position;

said first and second hinge parts having mutually contacting electrically conducting portions when said first and second hinge parts are in said mating position;

said electrically conducting portions being in electrical contact with said conductive surfaces of said two members;

each hinge part comprising a first element extending in a direction substantially perpendicular to the axis;

the hinge parts being secured together by at least one second element extending along the axis from the first element of one of the hinge parts; and the at least one second element being received within the first element of the other of the hinge parts.

7. The interconnect of claim 6 further comprising electrically conductive traces establishing said electrical contact between said conductive surfaces of said two members, and said electrically conducting portions of said first and second hinge parts.

8. The interconnect of claim 7 further comprising insulating leaf portions that carry said first and second hinge parts and on which said electrically conductive traces are located.

9. The interconnect of claim 6 wherein the at least one second element comprises an insulating pin extending through holes in said first and second hinge parts, said first and second hinge parts pivoting about said pin.

10. The interconnect of claim 9 further comprising screw threads on one end of said pin, and a threaded receiver portion in one of said hinge parts to receive said screw threads on said pin.

11. The interconnect of claim 6 wherein said first hinge part includes at least one male protrusion with one of said electrically conducting portions located thereon and said second hinge part includes at least one female socket with one of said electrically conducting portions located therein, the at least one male protrusion being snap fit within the at least one female socket when placed in the mating position.

12. An interconnect for electrically connecting two members having conductive surfaces, the interconnect comprising:

first and second hinge leaves of electrically insulating material for connection to respective ones of said two members, each of said first and second hinge leaves comprising:

a pivot member mateably positionable with respect to a pivot member of the other hinge leaf to enable relative pivotal movement between said first and second hinge leaves in a mating position about an axis, an electrically conductive portion of said pivot member located to contact a conductive portion of the pivot member of the other leaf when said leaves are in pivoting relationship, and electrically conductive traces along surfaces of said leaves in electrical communication with said conductive portions of said pivot members, said conductive traces being positioned so that when each said leaf is connected to a respective one of said two members, the conductive traces contact said conductive surface on said respective one of said two members, each pivot member comprising a first element extending in a direction substantially perpendicular to the axis, the hinge leaves being secured together by at least one second element extending along the axis from the first element of one of the pivot members; and the at least one second element being received within the first element of the other of the pivot members.

13. The interconnect of claim 12, wherein the at least one second element comprises a pin of electrically insulating material for rotatably engaging the pivot members of said hinge leaves to secure the hinge leaves in their mating position.

14. The interconnect of claim 12 wherein the pivot member of one hinge leaf comprises a male protrusion and the pivot member of the other hinge leaf comprises a female socket, the male portion being snap fit within the female socket to establish the mating position.

15. An electrical interconnect, comprising:

first and second hinge members, said first hinge member being pivotally movable relative to said second hinge member about an axis, each hinge member comprising an electrically insulating polymer matrix leaf, an electrically insulating fibrous filler dopant in said matrix, said fibrous filler being convertible to an electrically conducting trace by exposure to heat, and electrically conductive traces of heat converted portions of said insulating fibrous filler along a surface of said leaf, whereby the conductive traces of said first and second hinge members are maintained in electrical contact through a range of pivotal movement of said first hinge member, each hinge member comprising a first element extending in a direction substantially perpendicular to the axis, the hinge members being secured together by at least one second element extending along the axis from the first element of one of the hinge members, and the at least one second element being received within the first element of the other of the hinge members.

16. The interconnect of claim 15 wherein the at least one second element comprises a pin of electrically insulating material for securing said first and second hinge members in pivotally movable relative positions.

17. The interconnect of claim 15 wherein the first hinge member includes at least one male protrusion with the conductive trace formed thereon and the second hinge member includes at least one female portion with the conductive trace formed therein, the at least one male protrusion being snap fit within the at least one female portion to establish electrical connection between the conductive traces and permit the first hinge member to pivot relative to the second hinge member.

* * * * *